United States Patent [19]

Boucherie

[11] Patent Number: 4,580,845

[45] Date of Patent: Apr. 8, 1986

[54] AUTOMATIC FIBRE FEEDING FOR BRUSH-MANUFACTURING MACHINES

[75] Inventor: Leonel P. Boucherie, Roeselare-Rumbeke, Belgium

[73] Assignee: Firma G. B. Boucherie, naamloze vennootschap, Izegem, Belgium

[21] Appl. No.: 601,174

[22] Filed: Apr. 17, 1984

[30] Foreign Application Priority Data

Jun. 17, 1983 [BE] Belgium ..... 2/60129

[51] Int. Cl.[4] ..... A46D 1/04

[52] U.S. Cl. ..... 300/7; 300/21

[58] Field of Search ..... 300/1-19, 300/21; 221/225, 227, 232, 238, 239, 251, 254; 222/361, 366

[56] References Cited

U.S. PATENT DOCUMENTS 4,111,491 9/1978 Steinebrunner et al. ..... 300/21

FOREIGN PATENT DOCUMENTS 881914 2/1980 Belgium .

*Primary Examiner*—Mark Rosenbaum

*Attorney, Agent, or Firm*—Schwartz, Jeffery, Schwaab, Mack, Blumenthal & Evans

[57] ABSTRACT

The device according to the invention is of a concept whereby means are provided per brush-manufacturing machine, that can contain a series of cassettes, that are placed above or beside each other and that, under control, can be brought opposite the fibre magazine of the machine one by one to be emptied into this fibre magazine.

30 Claims, 10 Drawing Figures

AUTOMATIC FIBRE FEEDING FOR BRUSH-MANUFACTURING MACHINES

BACKGROUND

1. Field of the Invention

This invention relates to automatic fibre feeding for brush-manufacturing machines, in other words a device that allows increase in the autonomy of a brush-manufacturing machine considerably.

2. Prior Art

Such devices are already known in which, either a relatively large fibre container is used, out of which, during a relatively long period, fibres can be taken and supplied to the machine in question, or a so-called fibre loader is used that can be applied and replaced in a simple way and that consists of several compartments that can be emptied one by one into the fibre magazine of the machine. In the latter case the compartments will either be formed in the fibre loader itself, or be formed by cassettes that are placed in the fibre loader. Such a fibre loader is described in the Belgian Pat. No. 881.914 of the applicant.

OBJECTS AND SUMMARY OF THE INVENTION

The device according to the invention is of a concept that is a cross between the above-mentioned construction possibilities, whereby means are provided for each brush-manufacturing machine that can hold a series of cassettes that are piled on top of each other and that, under control and under the influence of their own weight, can one by one by brought in front of the fibre magazine of the machine to be emptied in this fibre magazine.

This automatic fibre feeding substantially consists of a guide, vertically mounted onto the brush-manufacturing machine for cassettes, freely piled on top of each other and containing fibres; means that can temporarily hold the cassette located beside the fibre magazine of the machine and, after emptying of the cassette, can move the latter, together with the cassettes located on top of it, downward over the height of one cassette; means that push the bottom filled cassette against the fibre magazine and support this cassette; means that guide and support the cassette at the place of the fibre magazine in relation to the latter; means that can affect the fibres in each cassette in order to push the fibres out of the cassette and bring them into the fibre magazine under an appropriate pressure; and means that can affect the cassette when the above-mentioned means are retracted in order to bring the cassette in question back in line with the other cassettes.

BRIEF DESCRIPTION OF THE DRAWINGS

In order to show the characteristics of the invention more clearly, a preferably embodiment of such fibre feeding is described hereinafter as a example without any limiting scope and with reference to the accompanying drawings, wherein.

DETAILED DESCRIPTION OF THE INVENTION

Figures 1, 4, 5, 6, 7, 8, 9:
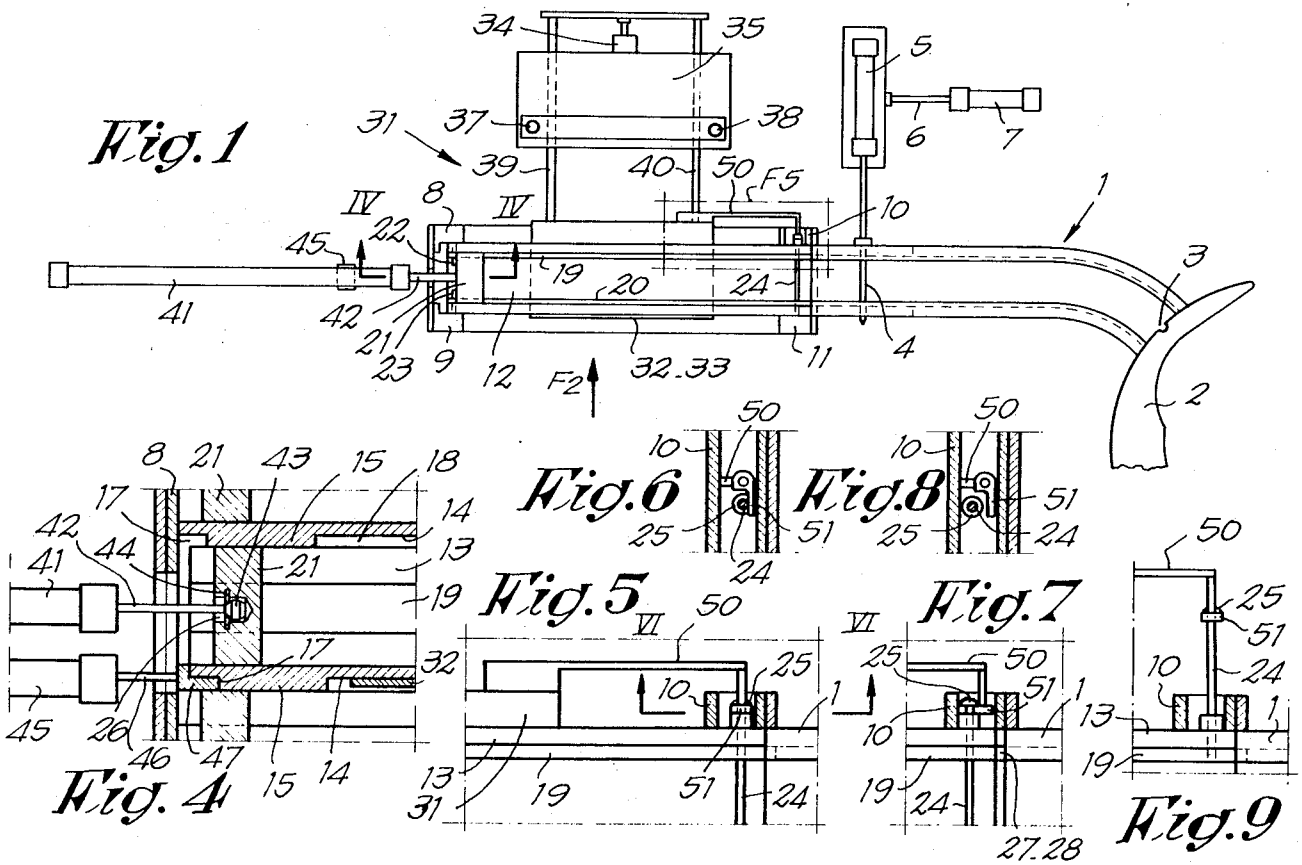
FIG. 1 represents a schematic top view of the automatic fibre feeding according to the invention.
FIG. 4 represents a cross-section, made along line IV—IV in FIG. 1, on a greater scale.
FIG. 5 represents the part that is designated by F5 in FIG. 1, on a greater scale.
FIG. 6 represents a cross-section, made along line VI—VI in FIG. 5.
FIGS. 7 and 8 are views that correspond to FIGS. 5 and 6, but for a second characteristic position.
FIG. 9 is a view similar to that of FIG. 7 but for another characteristic position.

In the accompanying figures an automatic fibre feeding according to the invention is represented in a schematic way. It is located in front of a fibre magazine 1 of a not shown brush-manufacturing machine, out of which, in a generally known way, by means of a so-called crescent 2 with a notch 3, bundles of fibres are removed consecutively to be processed by the machine.

With this fibre magazine a pressure element 4 co-operates with and exercises a constant pressure on the fibres present in the fibre magazine in order to insure that the pressure of the fibres on the crescent 2 is sufficiently high so that enough fibres can always be taken up by the notch 3.

This pressure element 4 is for instance formed by the piston rod of a pressure cylinder 5, that itself is connected to the piston rod 6 of a pressure cylinder 7. Herein the pressure cylinder 7 provides for the pressure of the needle 4 on the fibres in the magazine 1, while the pressure cylinder 5 sees to it that the needle 4 can be moved into and out of the magazine.

The device according to the invention mainly consists of four guides appropriately connected to each other, respectively 8–9 and 10–11, between which a number of identical cassettes 12, filled with fibres, can be applied. The cassettes 12 mainly consist of a U-shaped profile 13, the length and width of which are such that they can be applied freely slidable, but tightly fitting between the guides 8 to 11.

Such cassette shows two projections at its bottom wall 14, respectively 15 and 16, so as to form two spaces, respectively 17 and 18, the purpose of which will become clear hereinafter; whereby at the inside of the flanges of the cassette that are located opposite to each other, sliding slats, respectively 19 and 20, are provided for a push-out block 21.

At one end of the cassette a pair of stops 22 and 23 are provided for the push-out block 21, whereas at the other end of the cassette a pin 24 is attached that can be pulled out, which pin is provided at its free end with a widened part of the head 25, that is at a small distance A of a projection that is provided on the cassette wall and that serves as a guide for the pin 24.

The push-out block has a hole 26, that is provided at the inside with a not shown small spring or the like, the purpose of which will become clear hereinafter, whereas the above-mentioned sliding slats 19 and 20 are provided at the end that is located near the above-mentioned pin 24 of two projections, respectively 27–28 and 29–30, that can co-operate in a not shown way with the fibre container 1 in order to be able to situate the cassette and to allow the transition of fibres from the cassette to the fibre container without any problems.

The device according to the invention is completed by a fork-shaped element 31 the teeth 32 and 33 of which fit in the space 18 of a cassette, whereby this element 31 is attached to the piston rod of a pressure cylinder 34, that is mounted on a support 35 that is itself commanded by a pressure cylinder 36 that rests on the frame of the machine. The support 35 is vertically movable along guides 37 and 38 that are also mounted on the machine frame, this element 31 being provided with guides 39 and 40 so that it is slidable in relation to the support 35.

At the height of the fibre magazine 1, in the extension of this fibre magazine, respectively in the extension of a cassette that is located in front of this fibre magazine, a pressure cylinder 41 is provided the piston rod 42 of which can co-operate with a push-out block 21 of a cassette 12. For this purpose the free end of the piston rod 42 is provided with a thickening 43 that can co-operate with the above-mentioned opening 26 in the pusher-block 21, whereby thhe little spring 44 attached in this hole assures that the thickening 43 behind this spring 44 can be secured during the movement of the pusher block 21 in order to obtain that at the end of the movement, by the moving back of the piston rod 42 the pusher block will be moved backwards again to obtain eventually that, when the pusher block touches the stops 22 and 23, the force executed by the thickening 43 on the above-mentioned small spring 44 becomes so great that this spring yields and the thickening is released from the pusher-block 21.

Under the pressure cylinder 41 another pressure cylinder 45 is provided, the piston rod 46 of which, at its free end, bears an L-shaped element 47 the purpose of which is to push a cassette, that has come in the extension of the fibre magazine 1, along a small distance up to the fibre magazine 1, and on the other hand, to support this cassette when the bottom tooth 33 of the fork-shaped element 31 is pulled away from under the cassette.

At the opposite side of the cassette a small block 48 is provided at this place that is pushed away as well during the pushing along of the cassette by means of element 47, against the action of a spring 49, the purpose of which is, when the element 47 is pulled back again, when a cassette has been emptied into the feeding magazine 1, to bring this cassette under the influence of the spring 49, back in the position where it can move downwards in the guides 8 to 11.

Finally an arm or projection 50 is attached to the fork-shaped element 31 the free end of which carries a little hook 51 that can co-operate with the head 25 of the pin 24, as will become apparent hereinafter.

The operation of the automatic fibre feeding according to the invention is quite simple.

Figure 3:
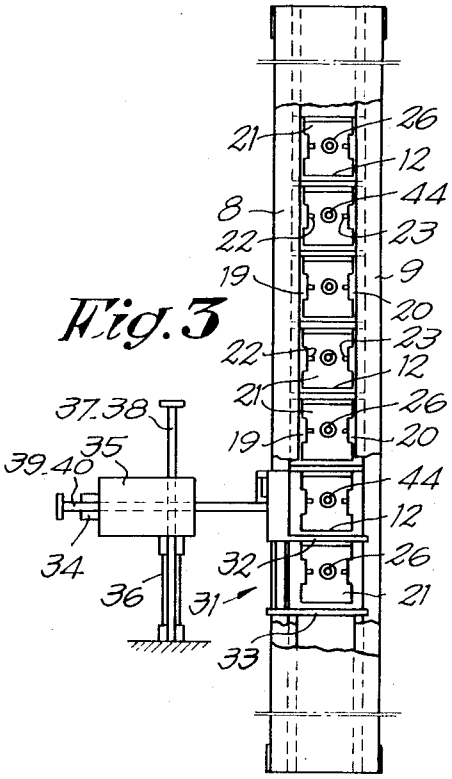
FIG. 3 is a view according to arrow F3 in FIG. 2.
Figure 2:
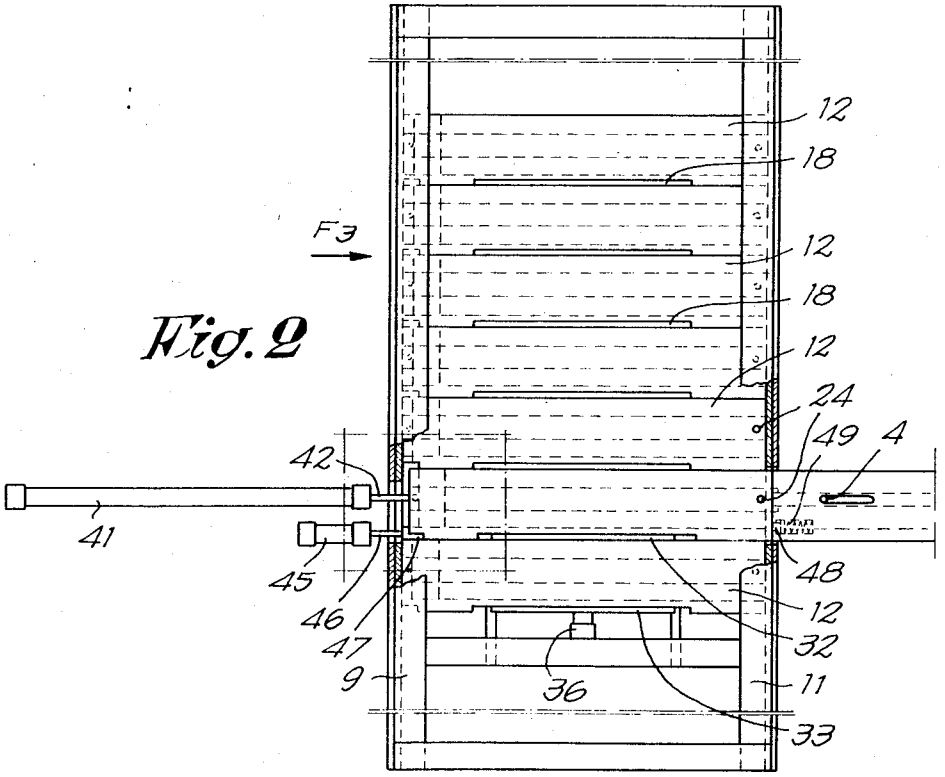
FIG. 2 is a view according to arrow F2 in FIG. 1.
Figure 10:
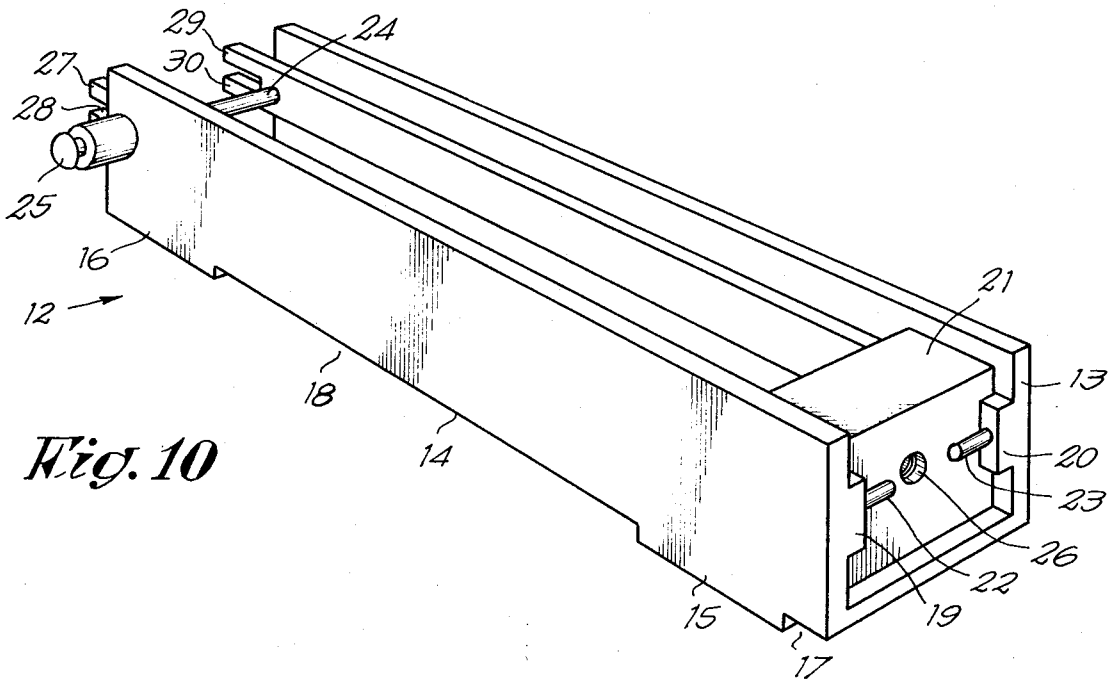
FIG. 10 represents a perspective view on a cassette according to the invention.

While in the magazine 1 a number of fibres are located that are being pressed together by the needle 4, the teeth 32–33 of the fork 31 will be removed from the space 18 of the two empty bottom cassettes in the FIGS. 2 and 3, with the result that the bottom cassette 12 can freely slide downwards between the guides 8 to 11 to be received properly.

Then the teeth 32–33 are moved upwards along the height of one cassette 12 to be placed subsequently under the at this moment empty bottom cassette and the second still filled cassette 12.

At this moment the support and pusher-element 47 is retracted so that the cassette 12 that is located at the height of the fibre magazine is pushed to the cylinder 41 under the influence of the block 48 to come in line with the other cassettes 12.

Meanwhile the pusher-block 21 was retracted by cylinder 41 and at the end of the movement of this pusher-block 21, by the presence of the stops 22–23, the thickening 43 will be released from the cavity 26.

Subsequently the fork 31 is being moved downwards along the height of one cassette 12, together with the bottom empty cassette, wereby the top cassettes, under the incluence of their own weight, follow this movement.

When the bottom full cassette 12 has come opposite the fibre magazine 1, the support and pusher-element 47 will push this cassette 12 to the fibre magazine and support is as shown in FIG. 2 whereby the block 48 is pushed in and the cassette is precisely positioned, by means of the projections 27–28 and 29–30, in relation to the fibre magzine 1. At this moment the cassette rests on a support that is for instance formed by the bottom edge of the passage of the cassette 12 through the cassette guide, to the fibre magazine 1.

By this movement of the cassette 12 the small hook 51 comes into the position as indicated in the FIGS. 5 and 6, from the position as indicated in the FIGS. 7 and 8, whereby the head 25 of the pin 24 is brought behind the small hook 51, whereafter this hook is brought into the position according to FIG. 9 by the movement of the element 31 to pull the pin 24 out of the cassette.

The piston rod 42 is now pushed out and the thickening 43 penetrates into the cavity 26 of the pusher-block 21 that presses the fibres onto the needle 4, that is pulled out of the fibre magazine and is placed back into the initial position by the cylinder 7 as to, at the right moment, in other words when the block 21 has come at the end of the movement, be brought into the fibre mass again to take over the pressing of the fibres during the exchange of a cassette.

When the cassette is empty the pin 24 is pulled back into the cassette by appropriate, not shown means.

In this way an automatic fibre feeding is formed that consists in a guide for loose cassettes that are filled with fibres outside the machine.

This can for instance proceed in a place where the cassettes for all brush-manufacturing machines are filled, the transport of empty and filled cassetes taking place manually or automatically.

Although in the description an example is given where the cassettes are placed vertically on top of each other, the invention also extends to embodiments where the cassettes are placed horizontally side by side. In the latter case the cassettes will not be moved by their own weight but positively guides.

The invention is also applicable when working with two sorts of fibres, for instance two colours. For that purpose the described device could be provided once as represented and once in reverse.

Naturally this invention is not limited to the embodiment described as an example and represented in the accompanying drawings but such automatic fibre feeding can be realised in a number of forms and dimensions without departing from the scope of the invention.

I claim:

1. Automatic fibre feeding for brush-manufacturing machines, comprising: a guide (8-9-10-11) for cassettes (12) with fibres mounted on the brush-manufacturing machine; means (31) for temporarily holding the cassette (12) located beside the fibre magazine (1) of the machine, and after emptying of the cassette (12) for moving the latter; means (47) for pushing the cassette (12) located beside the fibre magazine (1) against the fibre magazine (1) and supporting the cassette (12); means for guiding and supporting the cassette (12) at the place of the fibre magazine (1) in relation to the latter; means (41) for pushing the fibres under an appropriate pressure out of the cassette and for carrying the fibres into the fibre magazine (1); and means (48–49) for affecting the cassette (12) when said cassette pushing means (47) is retracted in order to bring the cassette in question (12) back in line with the other cassettes.

2. Automatic fibre feeding according to claim 1, wherein affecting means (48–49) are formed by a small block (48) on which a spring (49) acts.

3. Automatic fibre feeding according to claim 1, wherein each cassette (12) comprises a profile having a substantially U-shaped cross-section, in which profile a fibre pusher-block (21) is slidable and whereby a pin (24) is provided that can be pulled out at one end.

4. Automatic fibre feeding according to claim 3, wherein the pusher-block (21) co-operates with a plurality of guides (19–20) at the inner sides of flanges of the U-shaped profile, whereby the extreme movement of the block (21) at one cassette end, is limited by a pair of stops (22–23).

5. Automatic fibre feeding according to claim 3, wherein the block (21) is provided with a snap hole (26) and a piston rod (42) having a free end cooperating with a pressure cylinder (41).

6. Automatic fibre feeding according to claim 3, wherein said pin (24) having a pair of ends rests at one end and outside the cassette in a guide, said one end of said pin (24) is provided with a thickening or head (25).

7. Automatic fibre feeding according to claim 3, wherein said cassette (12) at the bottom in the middle on the one hand, and at at least one end of the other hand, includes a recess (18) and (17).

8. Automatic fibre feeding according to claim 3, wherein the end in which said pin (24) is provided with at least one projection (27–30) that can co-operate includes the fibre magazine (1) of the machine.

9. Automatic fibre feeding according to claim 1, wherein said holding means (31) comprises a fork-shaped element with teeth (32–33) that are placed on top of each other at the height of one cassette (12), said teeth (32–33) fitting into excesses (18) in the cassettes.

10. Automatic fibre feeding according to claim 9, wherein said teeth (32–33) are plate-shaped.

11. Automatic fibre feeding according to claim 9, wherein said holding element (31) is mounted on a horizontal guide (39–40) movable in a support (35) and controlled by a pressure cylinder (34), said support (35) being slidable along a vertical guide (37–38) and being controlled by a pressure cylinder (36).

12. Automatic fibre feeding according to claim 9, including an arm (50) mounted on said element (31), the end of which carries a small hook (51) that can co-operate with the end of a pin (24) provided in each cassette (12).

13. Automatic fibre feeding according to claim 1, wherein said cassette pushing means (47) comprises an L-shaped block controlled by a pressure cylinder (45), a vertical flange of which forms a pushing element for the displacement of the cassette (12) towards the fibre magazine (1) and a horizontal flange of which is a support for the cassette.

14. Automatic fibre feeding according to claim 1, wherein said cassette guiding and supporting means at the place of the fibre magazine in relation to the latter, is formed by a local passage in the cassette guide.

15. Automatic fibre feeding according to claim 1, wherein said fibre pushing means (41) is formed by a pressure cylinder, a free end of the piston rod of which includes a thickening that can co-operate with a snap hole (26) in the block (21) of a cassette (12).

16. Automatic fibre feeding for brush-manufacturing machines, comprising: a guide (8-9-10-11) mounted vertically onto the brush-manufacturing machine for cassettes (12) with fibres piled freely onto each other; means (31) for temporarily holding the cassette (12) located beside the fibre magazine (1) of the machine, and, after emptying of the cassette (12) for moving the latter, together with the cassettes located above it, downwards along the height of one cassette (12); means (47) for pushing the bottom filled cassette (12) against the fibre magazine (1) and supporting this cassette (12), means for guiding and supporting the cassette (12) at the place of the fibre magazine (1) in relation to the latter; means (41) for pushing the fibres out of the cassette under an appropriate pressure and bring them into the fibre magazine (1); and means (48–49) for affecting the cassette (12) when said cassette pushing means (47) is retracted in order to bring the cassette in question (12) back in line with the other cassettes.

17. Automatic fibre feeding according to claim 16, wherein each cassette (12) comprises a profile having a substantially U-shaped cross-section, in which profile a fibre pusher-block (21) is slidable and whereby a pin (24) is provided that can be pulled out at one end.

18. Automatic fibre feeding according to claim 17, wherein the pusher-block (21) co-operates with a plurality of guides (19–20) at the inner sides of flanges of the U-shaped profile, whereby the extreme movement of the block (21) at one cassette end, is limited by a pair of stops (22–23).

19. Automatic fibre feeding according to claim 17, wherein the block (21) is provided with a snap hole (26) and a piston rod (42) having a free end cooperating with a pressure cylinder (41).

20. Automatic fibre feeding according to claim 17, wherein said pin (24) having a pair of ends rests at one end and outside the cassette in a guide, said one end of said pin (24) is provided with a thickening or head (25).

21. Automatic fibre feeding according to claim 17, wherein said cassette (12) at the bottom in the middle on the one hand, and at least one end on the other hand, includes a rescess (18) and (17).

22. Automatic fibre feeding according to claim 17, wherein the end in which said pin (24) is provided with at least one projections (27–30) that can co-operate includes the fibre magazine (1) of the machine.

23. Automatic fibre feeding according to claim 16, wherein said holding means (31) comprises a fork-shaped element with teeth (32–33) that are placed on top of each other at the height of one cassette (12), said teeth (32–33) fitting into excesses (18) in the cassettes.

24. Automatic fibre feeding according to claim 23, wherein said teeth (32–33) are plate-shaped.

25. Automatic fibre feeding according to claim 23, wherein said holding element (31) is mounted on a horizontal guide (39–40) movable in a support (35) and controlled by a pressure cylinder (34), said support (35) being slidable along a vertical guide (37–38) and being controlled by a pressure cylinder (36).

26. Automatic fibre feeding according to claim 23, including an arm (50) mounted on said element (31), the end of which carried a small hook (51) that can co-operate with the end of a pin (24) provided in each cassette (12).

27. Automatic fibre feeding according to claim 16, wherein said cassette pushing means (47) comprises an L-shaped block controlled by a pressure cylinder (45) a vertical flange of which forms a pushing element for the displacement of the cassette (12) towards the fibre magazine (1) and a horizontal flange of which is a support for the cassette.

28. Automatic fibre feeding according to claim 16, wherein said cassette guiding and supporting means at the place of the fibre magazine in relation to the latter, are formed by a local passage in the cassette guide.

29. Automatic fibre feeding according to claim 16, wherein said fibre pushing means (42) is formed by a pressure cylinder, a free end of the piston rod of which includes a thickening that can co-operate with a snap hole (26) in the block (21) of a cassette (12).

30. Automatic fibre feeding according to claim 16, wherein the affecting means (48–49) is formed by a small block (48) on which a spring (49) acts.

* * * * *